US005802858A

United States Patent [19]

Cheng et al.

[11] Patent Number: 5,802,858

[45] Date of Patent: Sep. 8, 1998

[54] CRYOGENIC COOLING TOWER

[75] Inventors: Alan Tat Yan Cheng, Livingston, N.J.; Donald Leonard Devack, Norwalk, Conn.

[73] Assignee: Praxair Technology, Inc., Danbury, Conn.

[21] Appl. No.: 826,288

[22] Filed: Mar. 27, 1997

[51] Int. Cl.[6] ..... F28C 1/00

[52] U.S. Cl. ..... 62/121; 62/905

[58] Field of Search ..... 62/121, 905

[56] References Cited

U.S. PATENT DOCUMENTS

| | | | |
|---|---|---|---|
| 310,025 | 12/1884 | Brewer | 62/121 |
| 2,963,872 | 12/1960 | Latimer | 62/905 |
| 3,427,228 | 2/1969 | Constantikes et al. | 62/905 |
| 3,461,677 | 8/1969 | Muenger | 62/905 |
| 4,113,435 | 9/1978 | Lagow et al. | 422/191 |
| 4,234,391 | 11/1980 | Seader | 62/905 |
| 4,281,119 | 7/1981 | Lagow et al. | 544/106 |
| 4,400,532 | 8/1983 | Lagow et al. | 560/227 |
| 4,430,865 | 2/1984 | Davis | 62/121 |
| 4,914,166 | 4/1990 | Kennedy et al. | 526/61 |
| 4,940,808 | 7/1990 | Schulz et al. | 549/436 |
| 5,207,068 | 5/1993 | Bridden | 62/121 |
| 5,267,444 | 12/1993 | Lehman et al. | 62/905 |
| 5,362,545 | 11/1994 | Cheng | 422/253 |

*Primary Examiner*—Ronald C. Capossela
*Attorney, Agent, or Firm*—Robert J. Follett

[57] ABSTRACT

A cryogenic cooling tower in which a process liquid from which heat is to be removed is supplied to the tower interior that has a plurality of plates vertically stacked one above the other, alternating in opposite directions and tilted downwardly at an angle relative to the tower vertical axis. A cryogenic cooling medium is supplied to the tower interior. The process liquid forms a film on the upper surface of the plate and drops from its front end to the next lower plate. While on a plate the process liquid spread into a film provides a greater surface area to react with the cooling medium to effect the heat transfer. The tilt angle of the plates can be adjusted to control the residence time of the process liquid in the tower.

20 Claims, 3 Drawing Sheets

CRYOGENIC COOLING TOWER

FIELD OF THE INVENTION

This invention relates to a cryogenic cooling tower having a high heat exchange efficiency for liquids, especially liquids of variable and high viscosity which are to be cooled.

BACKGROUND OF THE INVENTION

Process applications exist in which heat must be rapidly removed from a viscous process liquid (such as a solution, emulsion, or suspension) at room or at reduced temperatures. For highly exothermic reactions, it is sometimes necessary to carry out the reaction at very low temperatures to avoid a run-away reaction. Also, for selectivity reasons, a low reaction temperature range is often preferred because the selectivity for (rate of formation of) undesirable byproducts is often lowest at low temperature. At these low temperatures, the heat transfer driving force is reduced, which makes heat removal more difficult. Heat transfer from viscous liquids is also impeded by the viscosity of the liquid. The problem of rapid heat transfer from reaction mixtures that are both viscous and maintained at a low temperature is thus compounded.

When conventional heat-exchange equipment is used to remove heat from a process liquid, the cooling medium has to be substantially colder than the liquid to provide a temperature gradient sufficient for heat transfer. Any increase in process liquid viscosity during the process (e.g. reaction) will further complicate the problem of providing sufficient mixing for heat removal by the cooling medium. In certain types of reactions, formation of undesirable byproducts or run-away reaction can occur if the heat transfer is not sufficient.

A polymerization reaction is an example of an application during which the viscosity of the process liquid (or, more generally, reaction mixture) continues to increase, for example from about 0.7 cps (centipose) to about 100,000 cps, during the reaction. In a conventional polymerization process, it is usually necessary to use a large volume of solvent as a diluent to maintain the viscosity of the process solution at an acceptably low level for the process to be carried out, and for acceptable heat transfer to take place. If a large solvent volume is not employed, the polymerization rate has to be kept very low so that the unreacted monomer can act as a diluent of the product.

A number of polymers and elastomers are produced through cationic polymerization instead of free-radical or coordination-complex methods. Few free radical processes can be carried out effectively at temperatures below room temperature. Even when the free radicals can be generated, the rate of their propagation through the reaction fluid is very low. On the other hand, cationic polymerization can proceed rapidly at low temperature and the ionic species life is long. Therefore, for a cationic polymerization reaction, the residence time of the process liquid in the reactor and the reactor size are substantially lower than they would be if, e.g., a free-radical polymerization process had been employed. A nonlimiting example of a cationic polymerization reaction that illustrates heat transfer problems of the prior art is the polymerization of butyl rubber using aluminum trichloride as a catalyst. The exothermic reaction proceeds instantaneously as soon as the monomer is mixed with the catalyst. The reaction is normally carried out at a temperature of −65 C. to avoid a run away reaction. A large volume of solvent or monomer has to be used, which then has to be separated from the product (and recovered) after reaction.

Accordingly, it would be desirable and advantageous to be able to provide equipment that can maintain a high heat transfer rate despite increasing viscosity of a liquid phase, such as a reaction mixture to not only increase the heat transfer efficiency, but also to reduce the requirement for solvent or unreacted monomer in the foregoing and other similar processes.

Another type of situation in which rapid heat transfer would be desirable is encountered outside the context of exothermic reactions and/or reactions that result in a reaction mass or process liquid of high viscosity. For example, the heat produced by mixing different components also can cause problems requiring rapid heat transfer. For example, when sulfuric acid is mixed with an aqueous stream for pH adjustment, the temperature rise from the heat of mixing can bring the solution to boil. This problem is particularly acute during the processing of a substantial number of pharmaceutical intermediates because the temperature rise during mixing of ingredients can produce undesirable byproducts. To keep the mixing time reasonable, it is desirable to quench the process fluid temperature as soon as possible. When the reaction is carried out at very cold temperatures, such as below 0 C., it is difficult to provide a very high heat transfer rate.

The most conventional approach used to address the heat removal problem from various types of liquids involves use of mechanical chillers provided with a heat transfer fluid maintained at a low temperature and circulating in cooling coils which are installed within the reactor. However, a typical mechanical chiller using Freon has a temperature limit that seldom can be colder than −100 C. To provide a sufficient heat transfer driving force for certain applications, such as the fast cationic polymerization reactions, with this type of equipment, the temperature of the heat transfer fluid has to be even lower, e.g., −100 C. to −150 C. Ethylene is often used in a vapor recompression type of refrigerator but it is explosive when mixed with air. The required lower temperature thus limits the choice of the heat transfer fluid. Furthermore, even when the heat transfer fluid can reach the desired low temperature, the cooling rate can be limited by the size and surface area of the cooling jacket and cooling coils.

An alternative approach used is to sparge, or inject, cryogenic nitrogen directly into the process liquid. For low viscosity process liquids, this avoids the cooling rate limitation presented by the surface area of the cooling surfaces since the heat transfer occurs directly between the cryogenic nitrogen and the process liquid. There is no practical limitation of the temperature of the heat transfer fluid since cryogenic nitrogen can be as cold as −185 C.

However, none of the prior art approaches addresses the problems associated with a high-viscosity process liquid. The first problem is that the efficiency of heat transfer is much lower in a high viscosity liquid than in one having low viscosity. The second problem is that bulk mixing is difficult in a viscous liquid, with inadequate mixing resulting in warm and cold spots. The third problem is that thermal diffusivity decreases with an increase in viscosity of the liquid, making fast temperature quenching almost impossible.

In prior art systems in which liquid nitrogen is injected directly into a process liquid of high viscosity, the heat transfer efficiency, or refrigerant utilization, is very poor. When the viscosity of the process fluid is high, e.g. higher than 100 cps, the fluid surface tension and viscosity will exceed the breakage energy of the liquid nitrogen bubbles.

This causes the nitrogen bubbles to coalesce into large bubbles which transfer heat much less efficiently because of their lower surface-to-volume-ration. Also, larger nitrogen bubbles rise through the process fluid quickly and are exhausted through the top of the vessel, resulting in unacceptably short heat transfer times. As a result, not only is the amount of heat transfer from a cryogenic fluid into a viscous liquid very low, but also the refrigerant utilization is poor.

Liquid nitrogen boils at −185 C. When heat exchange takes place between the vaporizing liquid nitrogen and the surrounding process liquid, adequate bulk mixing is necessary to immediately raise the temperature of the supercooled cryogenic fluid. This is normally carried out by means of an agitator in an autoclave. However, it is known that the mass transfer coefficient decreases with increasing process fluid viscosity in the vessel in which the mixing takes place. The result is nonuniform temperature distribution, i.e. hot spots and cold spots. Also agitation may not be a viable alternative in certain cases if a nonuniform temperature (even a few degrees temperature deviation from a desired set point) can create large amounts of undesirable reaction byproducts (e.g., when the reactions taking place are temperature-sensitive).

Fast temperature quenching presents a challenge regardless of the viscosity of the process liquid broth. Sparging liquid nitrogen into a reactive process liquid does not achieve fast temperature quenching. The maximum amount of liquid nitrogen that can be injected into a volume of the process fluid per unit of time is limited: As liquid nitrogen vaporizes, it expands more than 700 times in volume. Too much vaporizing nitrogen can eventually fluidize the process fluid and even blow everything out of the reactor.

Additional problems are present when the viscosity of the process liquid changes from one reaction to another, and even during the course of one reaction. Prior art systems may be optimized for one set of reaction conditions but do not have flexibility to adapt to a new set of conditions.

Lastly, liquid nitrogen prices vary from location to location. For large scale manufacturing processes, liquid nitrogen is often not economical. The major cost components associated with using liquid nitrogen are the compression cost to liquefy nitrogen and the distribution cost. To reduce compression cost, liquid nitrogen can be replaced with a cryogenic cold gas, such as nitrogen gas that is compressed to a lesser degree, i.e. without reaching liquefying temperature but cold enough for the heat transfer. The compression cost, therefore, can be substantially reduced in most instances. The cost of cryogenic cold gas can be less than half that of liquid nitrogen. However, such use of the more economic cryogenic cold gas presents other disadvantages in the prior art systems. This is because a cryogenic cold gas has at least twice the volume as compared to the (vaporized) liquid nitrogen. This, combined with the reduced heat transfer capacity, quickly results in fluidizing the process liquid. Therefore, prior art systems are not capable of obtaining an economic benefit through the use of cryogenic cold gas.

OBJECTS OF THE INVENTION

It is therefore an object of the present invention to provide a cryogenic cooling tower with increased heat exchange efficiency which can effect heat exchange for fluids of different and even variable viscosities ranging from low to high.

A further object is to provide a cryogenic cooling tower having a plurality of downwardly tilted plates stacked one above the other with the tilt angle alternating in opposite directions on each of which the process liquid is spread out into a film to increase the surface area for contact with a cryogenic cooling medium.

Yet another object is to provide a cryogenic cooling tower capable of efficient heat exchange with process fluids of different and/or changing viscosity which can utilize a liquid or gaseous cooling medium.

An additional object is to provide a cryogenic cooling tower having a plurality of adjustable, downwardly tilted plates stacked one above the other and alternating in opposite directions on each of which the process liquid is spread out into a film and in which the tilt angle of the plates can be varied to control the residence time of the process fluid in the tower and its contact with a cryogenic cooling medium.

Other objects and advantages of the present invention will become more apparent upon reference to the following specification and annexed drawings.

BRIEF DESCRIPTION OF THE INVENTION

The present invention is directed to an apparatus for cooling a process liquid including but not limited to process liquids having a high viscosity as well as those whose viscosity changes during a reaction process. The invention utilizes a cooling tower having a plurality of plates stacked one above the other, each tilted downwardly at an adjustable angle relative to the vertical axis, with the tilt of each plate disposed in the opposite direction from the immediately adjacent plates. The process liquid is introduced into the tower and cascades downwardly in a path from one plate to the next lower plate substantially through the height of the tower. A cryogenic cooling medium, a liquid or cold gas, is also introduced into the tower.

The process liquid is sheared into thin layers flowing on the tilted plates. This increases the surface area of contact, i.e. the surface area of the process liquid available for heat transfer with the cryogenic fluid or cryogenic cold gas and increases the heat exchange efficiency. The gas-liquid contact time of the process fluid for heat transfer can be controlled by adjusting the tilt angle of the plates. Therefore, the apparatus can be used to accomplish efficient heat exchange for different types and viscosities of liquids, and even for process fluids the viscosity of which changes during a particular process, such as a reaction mixture.

DETAILED DESCRIPTION OF THE PREFERRED EMBODIMENT

As used herein "process liquid" or "liquid being processed" means any liquid substance, solution, suspension, slurry, emulsion or broth or other reaction mixture comprising a liquid phase without limitation in need of heat transfer.

Figure 1:
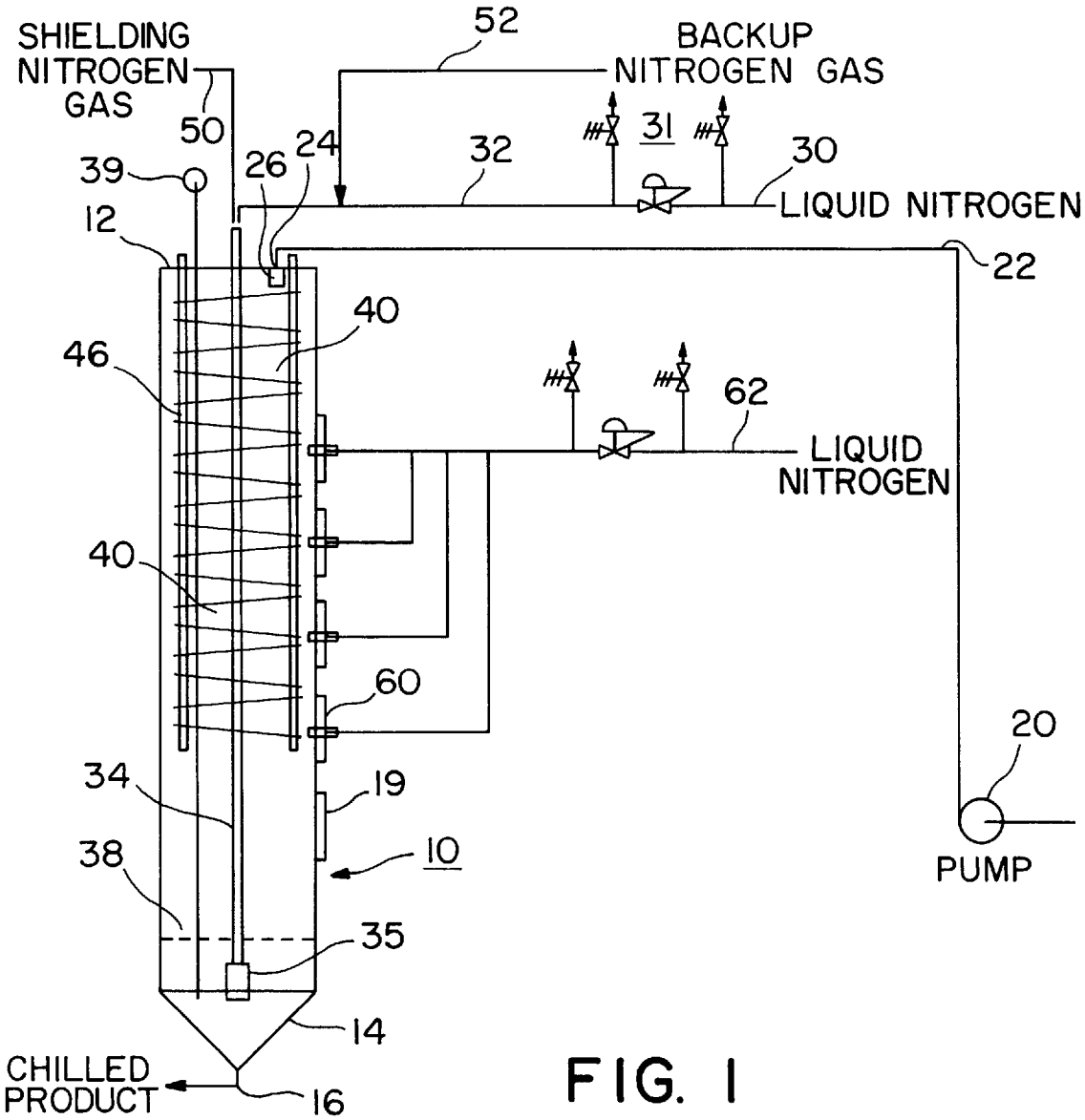
FIG. 1 is an elevational view of the tower and cooling system in schematic form.

Referring to FIG. 1, the cooling tower 10 is a reactor or other liquid-processing chamber of a suitable size, as desired, having a closed top 12 and a bottom 14 of generally conical shape with an outlet 16 for the chilled fluid. A window 19 is preferably provided through which the interior of the tower can be viewed. The tower 10 can be of any suitable material compatible with the contents of the process liquids that are to participate in the heat exchange process. If desired, the inner wall of the tower can be lined with a non-reactive material. Also, suitable insulation can be provided around the outside of the tower.

The liquid being processed is supplied from a suitable source, for example from a pump 20, over a conduit 22 to an inlet 24 at the top 12 of the tower through which the liquid being processed is introduced into the tower. There is preferably a distribution spray head 26 to more evenly distribute the liquid being processed into the tower interior.

A plurality of plates 40 are mounted on a supporting rod and guiding assembly 46 and extend at a downward angle relative to the vertical axis of the tower. Desirably, the plates 40 are all of essentially the same construction and are stacked one above the other with the tilt angle alternating in opposite directions. In other words, the lower end of each plate, described below, is above the higher end of the next lower plate. Each plate 40 extends only partially across the tower interior and the plates are partially staggered so that the film of the liquid being processed that is introduced into the top of the tower can flow across a plate and drop from its front end onto the back end of the next lower plate. The assembly 46 permits the angle of the plates to be adjusted as a group. The plates 40 are made of a suitable material such as plastic or metal, according to the temperature and non-reactivity requirements of the tower contents.

Figure 2:
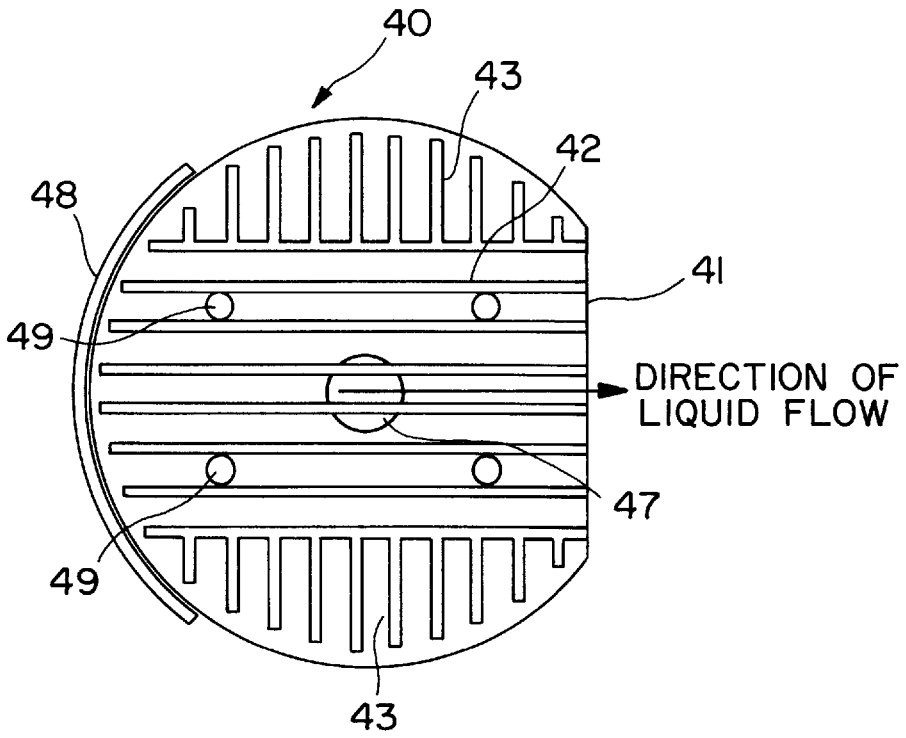
FIG. 2 is a top view of one of the plates.
Figure 2A:
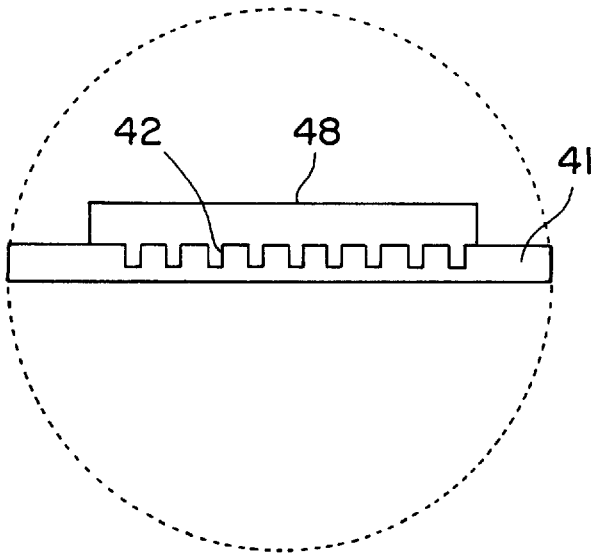
FIG. 2A is a side view of the plate of FIG. 2.

FIGS. 2 and 2A show the details of a plate 40 as configured for a tower with a circular interior. Each of the plates has essentially the same construction. The plate 40 is of generally circular shape with a cutout sector 41 that provides the open lower end from which the process liquid drops from one plate to the next lower plate when in the tower. The plate has a central hole 47 through which a conduit for the cooling gas passes, as described below.

The plate also has a plurality of holes 49, illustratively shown as four in number, through which the rods for the support and adjusting assembly 46 pass. By moving the rods of assembly 46, the tilt angles of the plates are adjusted as a group. To accomplish this, for example, there can be one leaf of a hinge secured to a rod of the assembly adjacent a hole 49 and the other hinge leaf secured to the lower surface of the respective plate. Any other suitable arrangement can be provided, e.g. one in which the tilt of each plate can be adjusted individually.

The upper surface of each plate has a central section of a plurality of parallel grooves 42 formed by machining or etching. Grooves 42 extend across the plate in the direction in which it is desired to have the liquid flow across the plate and off its lower end 41. The liquid then drops onto the back part of the next lower plate in the tower. On each side of the central section comprising grooves 42 is a section comprising grooves 43 that are generally transverse to grooves 42. The ends of the transverse grooves 43 communicate with the grooves 42 to convey liquid from the grooves 43 to the central section grooves 42. This configuration results in directing the liquid from the center section of a plate to the next lower plate and avoids the liquid flowing off the side of a plate. As an alternative to the groove pattern shown in FIG. 2, the grooves 43 can be cut in a fan shaped pattern with the "origin" of the fan being at the center of the plate. In the case of a rectangular tank (not shown) rectangular plates would be used and the grooves 42 would extend in the direction of plate tilt. Further arrangements of grooves on the plate will be apparent to those skilled in the art.

A vertically upstanding deflector 48 is provided on the edge of the back part of the plate (i.e., the part that is to be closest to the inner wall of the tower) to keep liquid from channeling to the tower side wall when the liquid is flowing from one plate to the next lower plate.

The purpose of each plate 40 and its grooves 42 and 43 is to disperse the liquid being processed (especially if the liquid is viscous) into a film over the plate upper surface and to keep the liquid dispersed as it flows from one plate to the next lower one. That is, the grooves direct the flow of the liquid. Due to surface tension, the liquid will not flow in a uniform film, or sheet, down a smooth plate set at an angle. For more viscous liquids the grooves 42 and 43 are preferably made wide and shallow and for less viscous liquids are made narrower and deeper. The dimensions of the grooves are selected to keep the film of the viscous liquid as thin as possible. Deeper grooves result in a thicker film and reduce the heat transfer efficiency.

The main supply of cooling medium (for example, liquid nitrogen) in the described embodiment, is provided from a conventional source 30 having the usual control valves 31 over a conduit 32. The liquid nitrogen flows through the center pipe of a double wall transfer pipe 34 and is injected through a main nozzle 35 (which can be of any suitable conventional type) into the bottom of the cooling tower. A temperature monitor probe 39 is placed in the collected cooled liquid at the tower bottom.

The liquid nitrogen injection point is preferably located just below the surface 38 of the collected cooled process liquid. This is desirable because the heat capacity of the process liquid is much higher than the vapor phase within the cooling tower which may typically consist of organic vapors and/or water and the vaporized nitrogen gas. Furthermore, the turbulent mixing of the liquid nitrogen with a liquid of high heat capacity will keep the liquid nitrogen injection nozzle 35 from freezing up with ice. The injected liquid nitrogen flows up through the cooled process liquid in the tank bottom, vaporizes and circulates through the tower interior where it is available to come into contact with and cool the process liquid on the plates 40. The heat exchange efficiency is not limited by bubble sizes produced during the reaction. The contact time between the liquid being processed and the cooling medium depends on the amount of cryogenic fluid or cold gas in the tower and not on the velocity of bubbles rising through a liquid.

A shielding gas, in the embodiment being described a nitrogen gas at room temperature, from a suitable source, is supplied by a conduit 50 to the outer pipe of the double walled liquid nitrogen transfer pipe 34. The nitrogen shielding gas maintains the temperature of the nozzle 35 above the freezing point of the process liquid.

Backup nitrogen gas from a suitable source is supplied over a conduit 52 to the center pipe of the double wall transfer pipe 34 to maintain the pressure inside the nozzle 35. The backup nitrogen gas from conduit 52 is pre-set at a lower pressure than the main supply of liquid nitrogen in conduit 32. When the liquid nitrogen from main source 30 is shut, or its pressure is reduced, the backup gas from conduit 52 will start flowing at the lower preset pressure. This keeps the liquid being processed from entering the nozzle 35. Since liquid nitrogen boils at −195 C., the inside of the nozzle 35 remains extremely cold even when the liquid nitrogen supply 30 is shut off. The backup gas prevents any process fluid entering nozzle 35 which will freeze instantaneously and plug the nozzle.

Injection ports 60 are shown mounted along the side wall of the tower and supplied with liquid nitrogen from a source 62. Ports 60 are optional. Each port 60 preferably has a nozzle with a very small opening to provide a fine diverging cone spray of liquid nitrogen. The flow rate of the nozzles of the ports 60 is relatively small as compared to that of the main nozzle 35 at the bottom of the tank. This is because the vaporized organic or water moisture in the tower has a much higher tendency to freeze on an exposed port 60 than on the main nozzle 35 submerged in the liquid. Therefore, the side ports 60 are optional and are not usually used unless a very high cooling rate is needed (such as in certain fast temperature quenching applications).

In operation of the tower, the process liquid is supplied from source 20 and injected into the top of the tower through nozzle 26 onto the uppermost downwardly tilted top plate 40 in the tower. The liquid flows over this plate to and off its front (i.e. lower) end and drops to the next lower plate. This downward flow continues from plate to plate throughout the height of the tower. Each plate 40 shears the liquid it receives and spreads it out into a thin layer, or film, producing a large surface area for heat transfer with the cooling gas (vaporized liquid nitrogen) that is circulating within the tower. The liquid drops from the lowermost plate 40 into the tower bottom after having been cooled during its downward travel from plate to plate. The collected chilled liquid is removed through the outlet 16.

As should be apparent, the process liquid has a long residence time in the tower as it travels from plate to plate as compared to a straight through flow. Also, the liquid is spread out over the surfaces of the plates to provide a large surface area for interaction with the cooling liquid. Both factors increase the cooling efficiency of the system.

The angle of the plates can be pre-set before the process or adjusted during the process. That is, the tilt angle of the plates 40 is adjusted according to the viscosity of the liquid to be cooled and/or the residence time desired (although, as is well-known, residence time can be also controlled with flow rate and number of plates 40 provided). The tilted plates however principally determine the residence time of the process liquid within the tower. If the tilt angle is not steep enough, a viscous liquid will stay on the plates and eventually block the flow of the vaporized nitrogen. If the angle is too steep, the process liquid will not have sufficient time for heat transfer. The plates 40 allow the system to compensate for the adverse effect of high viscosity on heat transfer by making the angle of plate tilt less steeply and thereby increase the residence time of the film of liquid on each plate. Also, in cases where the viscosity of the liquid increases (or decreases) during the time that the liquid is in the tower, the tilt angles of plates 40 can be progressively varied to accommodate the changing viscosity.

For the tower to operate properly with a highly viscous liquid, the coolant must be allowed to sweep the surface of the liquid but not bubble through it. If the coolant bubbles through the process fluid, foaming can become excessive for a viscous liquid. Foaming is undesirable because it will flood the tower and the process fluid may be blown out of the tower by the vaporizing coolant. Therefore, conventional picking and bubbling trays used in mass transfer towers should not be used because viscous liquid will stay on horizontally disposed flat surfaces for too long a time. The cryogenic cooling tower of the invention has no such flat surfaces or bubbling sieves. Therefore, it is particularly suitable for cooling viscous solutions and reactant mixtures.

When liquid nitrogen is used as the cooling fluid it vaporizes and the volume expands by more than 700 times. The distance between the plates 40 is made large enough to permit a large volume of gas to flow between plates. Adjusting the distance between the plates can also accommodate a changing demand for cooling rate from very slow cooling to rapid quenching, resulting in large change in volumetric flow rate of vaporized nitrogen (i.e. the plates also serve to "baffle" the cooling gas flow).

The following examples illustrate the efficiency of a cryogenic cooling tower made of stainless steel and having the dimensions: two feet in diameter, ten feet high. The tower has eighteen plates 40 made of TEFLON, with the grooves 42 and 43 being ¼ inch deep and with liquid nitrogen used as coolant:

| EXAMPLE 1 | |
|---|---|
| Process fluid | Water |
| Flow rate | 4.24 gpm |
| Fluid temperature in | 56° C. |
| Fluid temperature out | 30° C. |
| Liquid nitrogen consumption rate | 308 lb/hr |
| Liquid nitrogen temperature | −195° C. |
| Vaporized nitrogen vent temperature | 48° C. |
| Temperature of approach | 8° C. |
| Vent flow rate | 4,313 scf/hr |

| EXAMPLE 2 | |
|---|---|
| Process fluid | Water |
| Fluid flow rate | 5.29 gpm |
| Fluid temperature in | 33° C. |
| Fluid temperature out | 10° C. |
| Liquid nitrogen consumption rate | 391 lb/hr |
| Liquid nitrogen temperature | −195° C. |
| Vaporized nitrogen vent temperature | 28° C. |
| Temperature of approach | 5° C. |
| Vent flow rate | 5,468 scf/hr |

| EXAMPLE 3 | |
|---|---|
| Process fluid | Inulin solution |
| Fluid viscosity | 1,000 cps |
| Fluid flow rate | 6 gpm |
| Fluid temperature in | 75° C. |
| Fluid temperature out | 15° C. |
| Liquid nitrogen consumption rate | 1,083 lb/hr |
| Liquid nitrogen temperature | −195° C. |
| Vaporized nitrogen vent temperature | 66° C. |
| Temperature of approach | 9° C. |
| Vent flow rate | 15,146 scf/hr |

Each of the above examples shows that the cryogenic cooling tower is very efficient in transferring heat from the process liquid to the liquid nitrogen. This is shown by the very large temperature drop for the process liquid by the low temperature of approach, that is, the temperature difference between the incoming process liquid and the exhausting vaporized nitrogen. The temperature of approach is less than 10 C.

Figure 3:
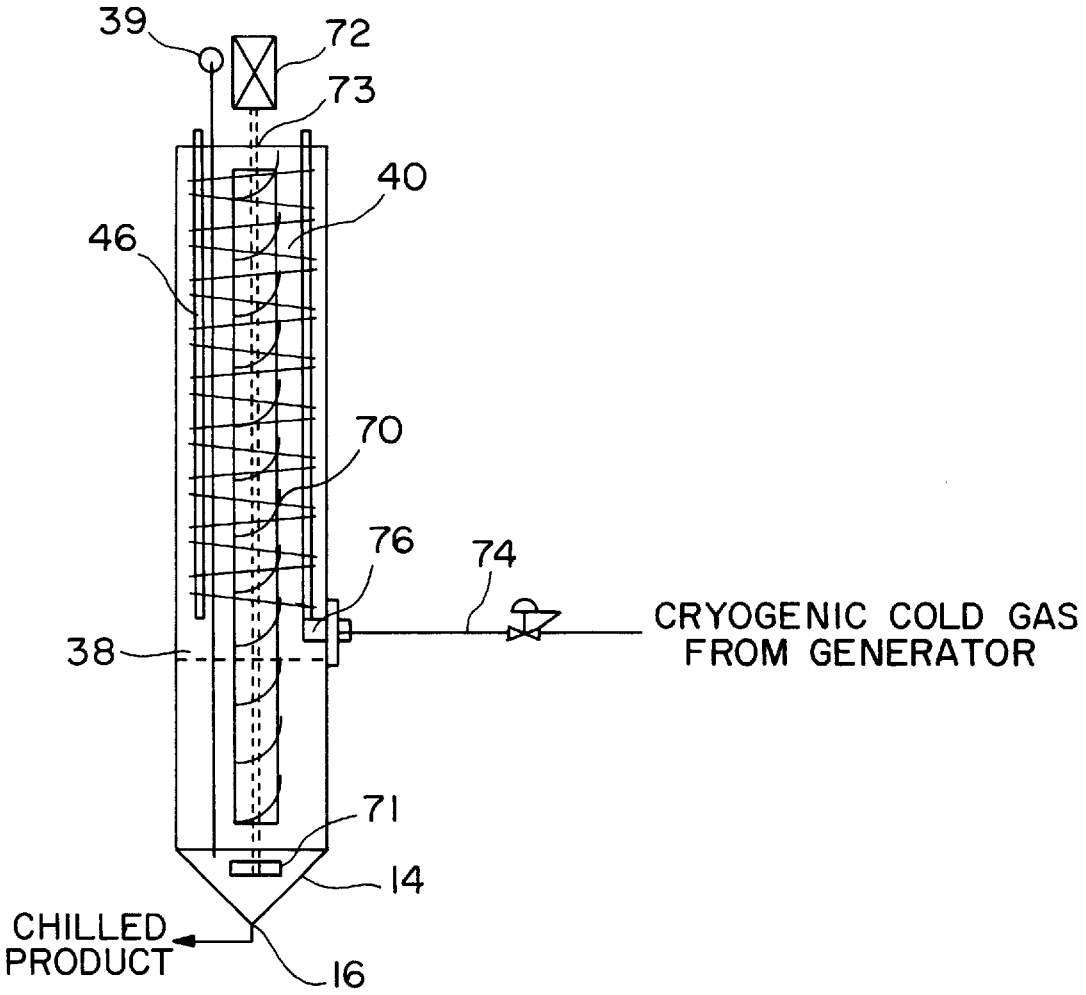
FIG. 3 is an elevational view of another embodiment of the cooling tower.

In addition to being a heat transfer system, the cryogenic cooling tower can also be a reactor. FIG. 3 shows such an arrangement in which the same reference characters are used for the same components shown in FIG. 1.

In the apparatus of FIG. 3 a screw conveyor 70 having an agitator blade 71 at its lower end is installed in the middle of the cooling tower and is driven by the output shaft 73 of a motor 72. Screw conveyor 70 extends through central holes in each of the plates 40 and can handle highly viscous liquid. The liquid reacting solution to be processed is supplied to the bottom of the screw conveyor. The cooling medium, here illustratively liquid nitrogen, or another cryogenic liquid or gas, is supplied from a generator (not shown) over a conduit 74 to a nozzle 76 interior of the tower. The nozzle 76 is above the upper surface level 38 of the cooled liquid that collects at the tower bottom.

The viscous process liquid is conveyed upwardly by the screw conveyor 70 to the top of the tower and is deposited on the uppermost tilted plate 40. As described with respect to the system of FIG. 1, the process liquid flows downwardly in the tower from plate to plate, spreads into a thin film on each of the plates 40 and is contacted with the cooling gas for heat transfer to take place. The outlet 16 at the tower bottom can be closed so that the chilled liquid that flows to the tower bottom will re-mix with the reacting process liquid broth to continue the cycle until the desired temperature has been achieved for the process liquid.

FIG. 3 also shows the cryogenic cold gas being injected directly into the space between the lowermost tilted plate 40 and the upper surface of the process liquid. This can be done since heat transfer is substantially more efficient at the tilted plate section rather than in the liquid pool at the bottom of the tower. Furthermore, cryogenic cold gas would require less heat capacity from the environment to soak up the refrigerant immediately upon injection. That is, liquid nitrogen at −193° C., a cryogenic liquid, will release all of its latent heat of vaporization when it comes in contact with the process fluid. The latent heat of vaporization can be more than the total sensible heat. Therefore, a large mass of process fluid has to be available to absorb the refrigeration. Otherwise, icing will occur. Cryogenic cold gas, on the other hand, may operate only 5 to 10 degrees below the desired process temperature and above the freezing point of the process fluid. Therefore, icing is no longer a problem. The cryogenic liquid is preferred to be injected below the liquid surface, such as shown in FIG. 1. It is preferred that cryogenic cold gas be injected above the liquid surface, such as in FIG. 3, although it can be injected above or below the liquid surface.

Other types of fixed trays or packing may be used in place of the tilted plates for rapid quenching of a solution. However, they will not be as effective in handling viscous liquid since a fixed tray or packing will not allow a change of the residence time of the liquid flowing down the tower. Flooding is a general phenomenon occurring when a viscous liquid is not flowing down the tower fast enough. On the other hand, heat transfer is inadequate if the liquid is flowing down too fast.

The cooling tower of the invention can handle a much higher ratio of gas to process liquid than conventional cooling equipment. The liquid flow rate through the tower can be made very low while a larger volume of cryogenic cold gas can be injected into the tower. Higher gas volumes can be used by adjusting (increasing) the spacing between the tilted plates. Because of this capability, cryogenic liquid nitrogen or cryogenic nitrogen gas (or other cryogenic liquid or gas) generated on site can be used in place of delivered liquid nitrogen. Without condensing the nitrogen all the way to a liquid state, the cost of refrigeration power can be reduced substantially. Further, compression power can be saved by supplying the cryogenic cold gas at even warmer temperatures. However, the volume of gas passing through the system has to be increased accordingly, which can be handled by this cryogenic cooling tower. Therefore, the cooling tower of the invention can take advantage of the more economical on-site generated cryogenic cold gas for viscous liquid. The tower of the invention also can be used for heating a reactant mixture or other process liquid by employing a heating gas medium instead of a cryogenic medium.

Specific features of the invention are shown in one or more of the drawings for convenience only, as each feature may be combined with other features in accordance with the invention. Alternative embodiments will be recognized by those skilled in the art and are intended to be included within the scope of the claims.

All cited documents are incorporated by reference in their entirety. In case of conflict, the present specification controls.

We claim:

1. A cooling tower to provide heat exchange for a liquid to be cooled comprising:

a tower;

a source of a cooling medium;

an inlet for injecting said liquid to be cooled into said tower interior;

a plurality of plates within said tower stacked spaced apart vertically one above the other, tilted downwardly at an angle relative to the tower vertical axis and alternately tilting in opposite directions, wherein said plates are located below said second inlet and above said source of said cooling medium such that said liquid to be cooled flows downwardly on said downwardly tilted plates and said cooling medium circulates upwardly within said tower, such that said liquid to be cooled is cooled by said cooling medium within said tower to produce a cooled process liquid;

a collection area at the bottom of said tower for collection of said cooled process liquid below said plates; and an outlet at the bottom of said tower for removal of said cooled process liquid.

2. A cooling tower as in claim 1 wherein the upper surface of a plate has a plurality of grooves thereon to aid in spreading the liquid to be cooled liquid thereover.

3. A cooling tower as in claim 2 wherein a first group of said plurality of grooves are aligned in the downward direction of tilt of the plate and extend to the front part of the plate from which the process liquid flows off to drop to the next lower plate.

4. A cooling tower as in claim 3 wherein a second group of said plurality of grooves are at an angle to and communicate with said first group of said plurality of grooves.

5. A cooling tower as in claim 4 further comprising an upstanding deflector plate on the part of the plate opposite that from which the liquid drops off the plate.

6. A cooling tower as in claim 2 further comprising an upstanding deflector on a part of the plate opposite which the liquid drops off the plate.

7. A cooling tower as in claim 1 further comprising an assembly to which said plates are mounted for adjusting the tilt angle of the plates.

8. A cooling tower as in claim 1 wherein the process liquid to be cooled is injected into the tower from an inlet at the top of the tower.

9. A cooling tower as in claim 8 wherein said cooling medium is liquid nitrogen and is injected into the cooled liquid collected in the tower bottom.

10. A cooling tower as in claim 1 further comprising a conveyor in the tower for conveying the process liquid upwardly to deposit onto an upper plate in the tower.

11. A cooling tower as in claim 1 wherein said cooling medium is liquid nitrogen and is injected into the cooled liquid collected in the tower bottom.

12. A cooling tower as in claim 1 wherein said cooling medium is a cooling gas that is injected into the tower at a point above the liquid collected in the tower bottom.

13. A cooling tower as in claim 12 further comprising a conveyor in the tower for conveying the process liquid including cooled liquid collected in the tower bottom upwardly to deposit onto an upper plate in the tower.

14. A cooling tower as in claim 1 further comprising an assembly to which said plates are mounted for adjusting the space between plates.

15. A process for cooling a liquid, said process comprising:

a) providing a cooling tower to provide heat exchange for said liquid, said cooling tower comprising:

i) a tower;

ii) a source of a cooling medium;

iii) an inlet for injecting said liquid to be cooled into said tower interior;

iv) a plurality of plates within said tower stacked spaced apart vertically one above the other, tilted downwardly at an angle relative to the tower vertical axis and alternately tilting in opposite directions, wherein said plates are located below said second inlet and above said source of said cooling medium;

v) a collection area at the bottom of said tower for collection of said cooled process liquid below said plates; and vi) an outlet at the bottom of said tower for removal of said cooled process liquid;

b) injecting said liquid to be cooled into said inlet;

c) passing said liquid to be cooled downwardly on said downwardly tilted plates;

d) circulating said cooling medium within said tower, such that said liquid to be cooled is cooled by said cooling medium within said tower to produce a cooled process liquid; and e) collecting said cooled process liquid in a collection area at the bottom of said tower below said plates.

16. The process of claim 15, wherein said cooling medium is liquid nitrogen.

17. The process of claim 15 wherein said inlet is at the top of the tower.

18. The process of claim 15, wherein said tower further comprises a conveyor in the tower for conveying the liquid to be cooled upwardly to be deposited onto an upper plate in the tower.

19. The process of claim 15, wherein said cooling medium is injected into the cooled liquid collected in the tower bottom.

20. The process of claim 15, wherein said cooling medium is a cooling gas, and said cooling gas is injected into the tower at a point above the cooled liquid collected in the tower bottom.

* * * * *